US005474014A

United States Patent [19]

Russell

[11] Patent Number: 5,474,014

[45] Date of Patent: Dec. 12, 1995

[54] NON-LINEAR TUNNEL HULL BOAT

[76] Inventor: Daniel N. Russell, 151 Barbados Ave., Tampa, Fla. 33606

[21] Appl. No.: 405,098

[22] Filed: Mar. 16, 1995

[51] Int. Cl.[6] ..... B63B 1/32

[52] U.S. Cl. ..... 114/288

[58] Field of Search ..... 114/62, 56, 57, 114/271, 274, 283, 288, 289, 290, 291

[56] References Cited

U.S. PATENT DOCUMENTS

| | | | |
|---|---|---|---|
| 3,148,652 | 9/1964 | Canazzi | 114/290 |
| 3,902,445 | 9/1975 | Stolk | 114/62 |
| 3,996,869 | 12/1976 | Hadley | 114/56 |
| 4,099,477 | 7/1978 | Caldwell | 114/291 |
| 4,574,724 | 3/1986 | Stolper | 114/288 |
| 4,644,890 | 2/1987 | Lott | 114/290 |
| 4,924,797 | 5/1990 | Solia | 114/288 |
| 5,351,641 | 10/1994 | Robson | 114/288 |

*Primary Examiner*—Stephen Avila

[57] ABSTRACT

This tunnel-hull uses non-linear flow means to maximize tunnel lift efficiency, fuel economy, and directional stability. The lower lateral hull planing surfaces have sharp, wedge-shaped step discontinuities defining multiple flat, smooth, planing surface sections having zero dead-rise angle. The steps decrease wetted surface area and increase hydrodynamic traction without adding draft. Downwardly extending curved lateral hull portions define a tunnel between their parallel inner edges. Random impressions in the undersurface of the tunnel relieve vacuum suction and create non-linear air flow for greater lift. Downwardly bent front edges of the tunnel and rear delta wing swim platforms are control surfaces that serve as safety brakes and prevent flipping. Tunnel air pressure increases in a gradient from bow to stern placing the center of lift aft of the center of mass, which provides safety from undue inclination and extra shock absorption. The planing surfaces are, alternatively in the form of endless rolling belts, which allow beaching and amphibious operation with high efficiency and without damage to the hull.

8 Claims, 1 Drawing Sheet

NON-LINEAR TUNNEL HULL BOAT

BACKGROUND OF THE INVENTION

The present invention relates to tunnel hull boats that maximize both tunnel lift efficiency and directional stability by non-linear flow means. Known tunnel hulls are unstable during high speed turns and exhibit excessive pounding and vacuum suction drag in choppy waves. They are built massively to withstand the associated stresses, so their additional mass, reduced buoyancy, instability, and tendency to flip counteracts the potential benefit in fuel efficiency.

It has been known to reduce the drag at the water-hull interface by introducing air via apertures in planing surfaces, as in Stolper, U.S. Pat. Nos. 4,574,724, and to Stolk, 3,902,445. This may reduce the directional stability of the planing surfaces and may introduce leakage problems through the apertures in the planing surfaces. This lubrication procedure also greatly increases the production cost. While it is well known that one of the most stable multi-hulls is the tunnel hull, their bows have exhibited a bias to be uplifted greatly under moderate speed operation because the center of lift has been in front of the center of mass. The small volume of air in the tunnels of the prior art relative to the displacement volume has required excessive engine power to make the tunnels operable.

It has been known to introduce steps and keels to overcome directional instabilities in tunnel hulls, as in Robson, U.S. Pat. Nos. 5,351,641, Caldwell, 4,099,477, and Hadley, 3,996,869. However, steps extending straight across the planing surface at the same depth exhibit slip on turning and keels add draft, drag, and danger to marine mammals and break easily when they strike floating objects. The number and height of step discontinuities in the planing surfaces of the prior art have been fixed. This has resulted in scaling problems. Since the size and number of step discontinuities need to be changed when the hull length and size is changed, these numbers should be functions of planing surface length. So there remains a need to develop a practical, safe, stable, light, fuel efficient, low cost tunnel hull boat that does not exhibit suction drag, pounding and maneuverability problems.

SUMMARY OF THE INVENTION

The object of the present invention is to provide an improved tunnel hull boat having non-linear air and water flow means that enable great improvements in directional stability, fuel economy, safety from flipping, maneuverability, economy of manufacture, and riding comfort without pounding and vacuum suction drag in rough waves. It is a further object to provide a superior combination of each of the above improvements together with a superior appearance.

These and other objects are achieved according to the present invention by a boat having downwardly extending lateral hull portions which define a tunnel between their parallel, inner, lower edges, so that the tunnel width is the same at the front as it is at the rear. The lower surfaces of the lateral hull portions are planing, non-linear surfaces having one sharp, 90°, wedge-shaped step break per meter of planing surface length defining multiple flat, smooth planing surface sections. These steps have a height of 0.2 to 0.8 percent of the planing surface length. The non-linear fluid flow aft of these step breaks add hydrodynamic directional traction without adding draft. Randomly sized and spaced impressions ½ to 10 centimeters in depth all over the undersurface of the non-linear tunnel relieve vacuum suction in rough waves and create non-linear air flow which enhances the lift efficiency of the tunnel. The front edge of the tunnel is bent down 5° to 80°. This is a control surface that shuts down the air flow to the tunnel when power is cut, which acts as a safety brake and prevents flipping. The flat triangular tunnel roof is parallel to the water line and inclined a constant 5° to 10° to the planing surfaces so that tunnel lift increases in a gradient from front to rear. Together with delta wings in the rear having at least the same inclination, this locates the center of lift aft of the center of mass. This provides safety from undue inclination as well as extra shock absorption for the stern. The range of the number of step breaks in the planing surfaces is not less than one step per 5 meters and not exceeding 3 steps per meter of planing surface length. The planing surfaces are, alternatively, endless rolling belts attached to the lateral hull portions by rollers.

DESCRIPTION OF PREFERRED EMBODIMENT

Figure 1:
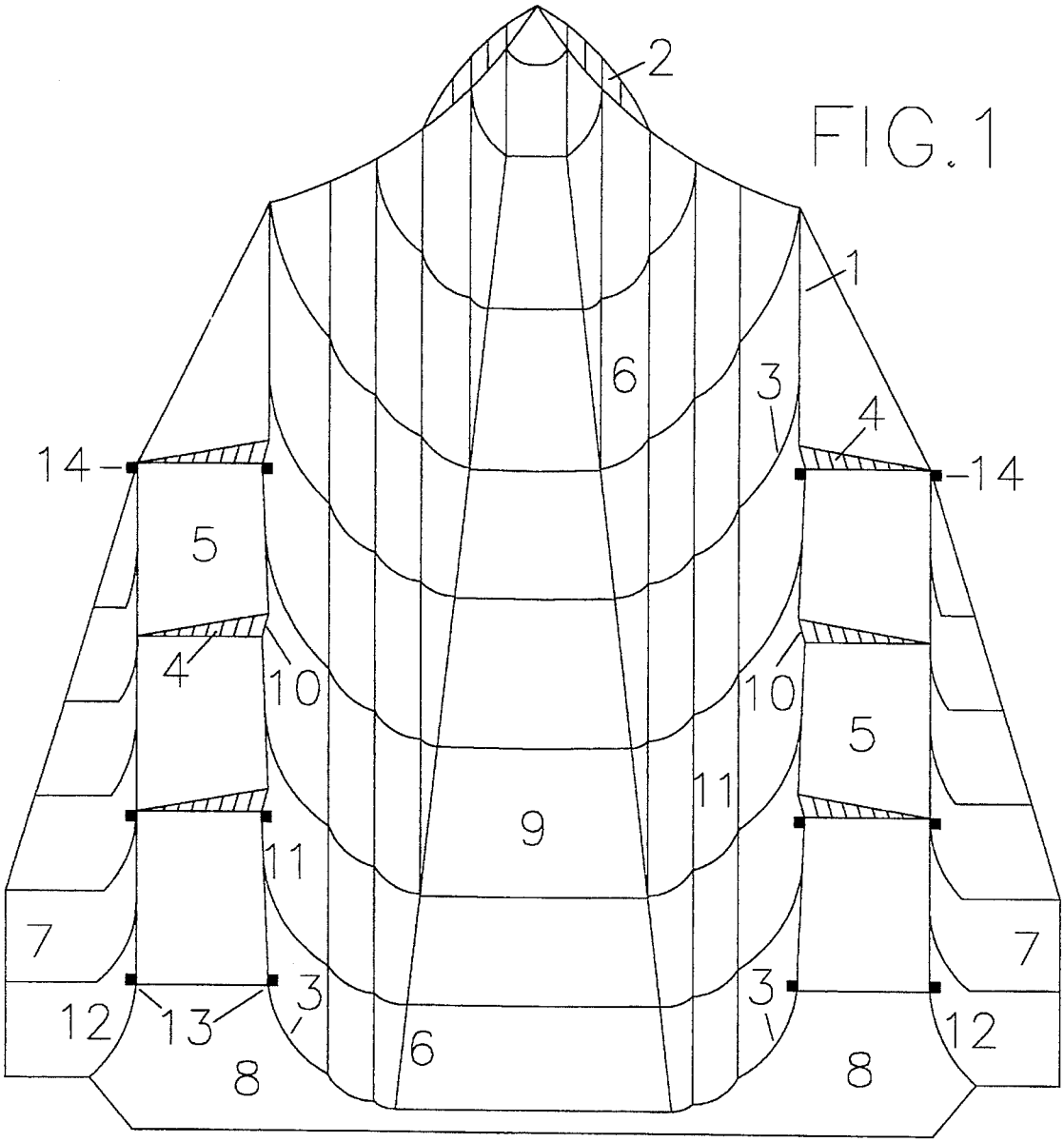
FIG. 1 is a bottom plan view of the non-linear tunnel hull.
Figure 2:
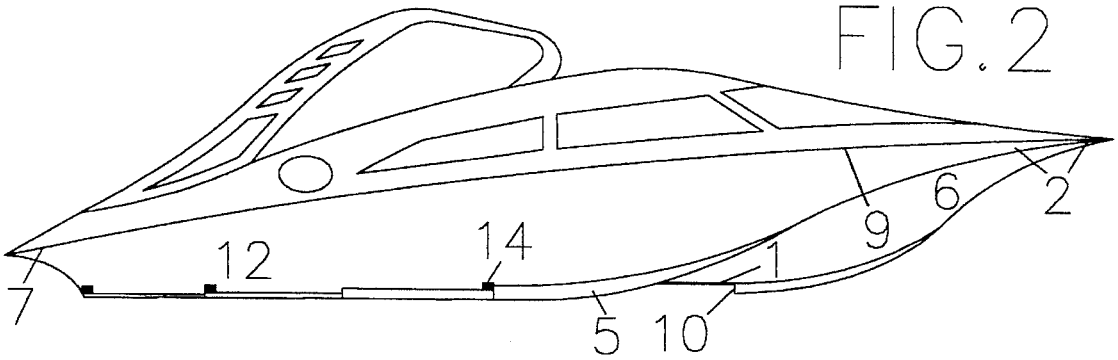
FIG. 2 is an elevational perspective view of the starboard side of a boat utilizing the hull of the instant invention shown in FIG. 1.

The three main features of the present invention, which contribute to the achievement of the objects of the invention, are tunnel configuration, planing surface shape, and control surface orientation. Referring to FIGS. 1 and 2 the preferred embodiment comprises a non-linear tunnel 6, lateral planing surfaces 5 and control surfaces 2 and 7. The entire tunnel surface 6 is covered with randomly sized impressions 3 ranging from 0.5 to 10 centimeters deep. This relieves vacuum suction from waves that strike the concave tunnel surface 6, and changes the air flow from laminar to non-linear which improves the lift efficiency by slowing down the air velocity adjacent to the tunnel surface 6. The inner lower lateral edges 1 are exactly parallel and straight, so that water is not pushed toward the inside between the planing surfaces 5. This combination of features overcomes wave slamming, vacuum suction drag and poor lift of the prior art. The flat triangular tunnel roof 9 has a constant inclination angle of 7° with respect to the planing surfaces 5 and is parallel to the water line. The angle could be as small as 5° or as great as 10° depending upon performance requirements. This inclination generates a pressure gradient within the tunnel increasing toward the rear. This, together with rear delta wings 7, place the center of lift well to the rear of the center of mass of the hull. The rear delta wings 7 are control surfaces having a constant angle of inclination at least as much as that of the tunnel roof 9 with respect to the planing surfaces 5. This combination of features overcomes the prior art problems of undue inclination and flipping and provides extra rear shock absorption for a boat, as in FIG. 2, using the instant inventive hull. The delta wings 7 double as swim platforms or boarding steps and may be hinged to flip up or rotate. The front edge 2 of the tunnel 6 is bent downward at least 5° from the plane of the tunnel roof 9 and is a control surface which automatically shuts down the air pressurization in the tunnel 6 when the engine power is cut. This control surface may also be mechanically rotatable. This control surface acts as an automatic safety brake and overcomes the safety problems of prior tunnel hull boats under excessive velocity or in dangerous headwinds.

The non-linear planing surfaces 5 have one sharp, 90°, wedge-shaped step break 4 per meter of planing surface length. The step height 10 is 2 to 3 centimeters per 5 meters of planing surface length and is measured at the inner edge 1 of the planing surfaces 5 and decreases laterally to zero away from the tunnel 6. The step breaks 4 are perpendicular to the inner edge 1 and the vertical portions 10 are perpendicular to the plane of the planing surfaces 5. This differs significantly from prior art steps in that the size and number of the step breaks 4, 10 of the instant invention are functions of planing surface length. This solves the scaling problems inherent in the prior art. The non-linear, turbulent fluid flow pattern generated aft of each step 4 provides both improved directional stability and reduced wetted surface area friction without adding drag, draft and danger to marine mammals. The wedge-shaped step breaks 4 are also novel and reduce slipping in high speed turns which has been a problem with steps that extend across the entire planing surface in the prior art. The angles of the planing surfaces 5 with lateral hull portions 11,12 at the transom 8 are 135° and shown by the angles 13. The measure of this angle 13 gradually decreases from aft to fore. This helps to reduce slamming of the hull in rough seas and increases buoyancy as an exponential function of loading at the transom 8. Instead of using various dead-rise angles and multiple chines as in the prior art, the inventive planing surfaces 5 have zero dead-rise angles. Planing is achieved solely via the lift of the tunnel 6, which is produced automatically as the forward velocity of the boat increases. Since the drag coefficient is much less at the air-tunnel interface than at the water-hull interface and since most of the boat weight is supported by the air column in the tunnel 6, the total drag is greatly reduced, because the hydrodynamic drag component of the total drag is reduced relative to the aerodynamic drag component. The planing surface width is at most one third of the tunnel width. The tunnel width measured between the parallel inner edges 1 of the planing surfaces 5 is at least one meter. The tunnel height is the perpendicular distance between the plane of the planing surfaces 5 and the tunnel roof 9. The tunnel height at the transom is at least 20 percent of the tunnel width. The preferred embodiment is constructed of fiberglass or carbon fiber reinforced resin with hollow microspheres of glass mixed with the resin. Alternatively the hull is built of aluminum or any combination of these materials. The hull is combined with any deck design in the construction of the non-linear tunnel hull boat.

In an alternative embodiment the planing surfaces 5 are in the form of endless rolling belts attached to the lateral hull portions 11, 12 by rollers made of nylon 14, teflon, or stainless steel, so that the final appearance is the same as that shown in FIGS. 1 and 2. This provides for high efficiency operation in grassy or muddy flats in shallow water, prevents damage to the hull from running aground or from beaching, and allows continued operation in contact with the ground.

The non-linear tunnel shape, planing, and control surface configuration as described herein above are novel features of the present invention. However, the instant invention is also the combination of these features and the relative orientations of each of these components in a single unit construction of the non-linear tunnel hull boat. It is this combination which provides a dramatically improved fuel efficiency, safety directional traction, and ride comfort with low manufacturing cost and superior appearance. Accordingly, for all these reasons set forth, it is seen that the nonlinear tunnel hull of the instant invention represents a significant advancement in the art of tunnel hull boats and has substantial commercial merit.

While there is shown and described herein certain specific structure embodying the invention, it will be manifest to those skilled in the art that modifications may be made without departing from the spirit and scope of the underlying inventive concept. The present invention shall not be limited to the particular forms herein shown and described, except by the scope of the appended claims.

What is claimed is:

1. A non-linear tunnel hull, consisting of: a pair of transversely curved and spaced, longitudinally extending parallel hull sections, and a longitudinally extending connecting section therebetween cooperating with said hull sections to define a tunnel extending from the fore end to the aft end of said hull, said tunnel being open at both ends and having surface impressions into the undersurface not less than 0.5 centimeters in depth and not more than 10 centimeters in depth, said hull sections having downwardly facing planing surfaces with parallel inner edges in common with lateral hull sections and with said tunnel, the distance between said inner edges defining the tunnel width which is the same at the fore end as it is at the aft end, said planing surfaces having no fewer than one wedge-shaped step break per 5 meters of length of said planing surface and no more than 3 wedge-shaped step breaks per meter of length of said planing surface, said step breaks having a height of not less than 0.2 percent of the length of said planing surfaces and not more than 0.8 percent of the length of said planing surfaces, said height being measured at said inner edges where it has a maximum value, said height decreasing to zero at the outer edges of said planing surfaces to define the wedge-shaped step breaks, said step breaks defining multiple planing surface sections each having zero dead-rise angle and no curvature about the transverse axis, said tunnel having a flat triangular roof with the apex at the fore end of said hull, said tunnel roof being parallel to the static water line, the plane of said roof having a constant angle of inclination of at least 5° relative to said planing surfaces.

2. The hull according to claim 1, wherein the vertical portion of said step breaks are perpendicular to said planing surfaces.

3. The hull according to claim 2, wherein said surface impressions are randomly sized and randomly placed into the undersurface of said tunnel, said planing surfaces have a width of at most one third of said tunnel width, said planing surfaces have one said step break per meter of length of said planing surfaces, and the perpendicular distance between the plane of said planing surfaces and said tunnel roof measured at the transom is at least 20 percent of said tunnel width.

4. The hull according to claim 2, wherein the fore end portion of said tunnel is bent downward relative to the plane of said roof of said tunnel at an angle of not less than 5° and not more than 80° and is a control surface.

5. The hull according to claim 4, wherein said lateral hull sections rise in cylindrical curvature from said planing surfaces at an angle of at least 135° measured at the transom, the measure of said angle gradually decreasing toward the fore end of said planing surfaces.

6. The hull according to claim 5, wherein the aft quarter of the outer sides of said lateral hull sections curve outwardly to form delta wing swim platforms having longitudinal inclination angle relative to the plane of said planing surfaces of at least the measure of the angle of said roof of said tunnel relative to said planing surfaces.

7. The hull according to claim 6, wherein said fore end portion of said tunnel and said delta wing swim platforms are mechanically rotatable, adjustable control surfaces.

8. The hull according to claim 1, wherein said planing surfaces are in the form of endless rolling belts attached to said lateral hull sections by rollers.

* * * * *